United States Patent [19]

Monsheimer et al.

[11] 4,351,639

[45] * Sep. 28, 1982

[54] PROCESS FOR LIMING PELTS OF ANIMAL HIDES AND SKINS

[75] Inventors: Rolf Monsheimer, Darmstadt-Eberstadt; Ernst Pfleiderer, Darmstadt-Arheilgen, both of Fed. Rep. of Germany

[73] Assignee: Röhm GmbH, Darmstadt, Fed. Rep. of Germany

[ * ] Notice: The portion of the term of this patent subsequent to Jan. 12, 1999, has been disclaimed.

[21] Appl. No.: 271,787

[22] Filed: Jun. 8, 1981

Related U.S. Application Data

[62] Division of Ser. No. 122,041, Feb. 19, 1980, Pat. No. 4,310,328.

[30] Foreign Application Priority Data

Mar. 23, 1979 [DE] Fed. Rep. of Germany ..... 2911401

[51] Int. Cl.[3] ..... C14C 1/08

[52] U.S. Cl. ..... 8/94.16

[58] Field of Search ..... 8/94.16

[56] References Cited

U.S. PATENT DOCUMENTS

| | | | |
|---|---|---|---|
| 1,763,319 | 6/1930 | Orthman | 8/94.16 |
| 1,844,769 | 2/1932 | Isermann et al. | 8/94.16 |
| 1,973,130 | 9/1934 | Turley et al. | 8/94.16 |
| 2,033,163 | 3/1936 | Wallerstein et al. | 8/94.16 |
| 2,155,087 | 4/1939 | Grassman et al. | 8/94.16 |
| 2,169,147 | 8/1939 | Jaeger et al. | 8/94.16 |
| 2,174,497 | 9/1939 | Hill | 8/94.16 |
| 3,271,258 | 9/1966 | Zviak et al. | 8/94.16 |
| 4,175,922 | 11/1979 | Eckert et al. | 8/94.16 |

FOREIGN PATENT DOCUMENTS

| | | |
|---|---|---|
| 2157034 | 5/1923 | Fed. Rep. of Germany . |
| 646721 | 4/1935 | Fed. Rep. of Germany . |
| 2053016 | 11/1973 | Fed. Rep. of Germany . |
| 50-897 | 1/1975 | Japan . |
| 433815 | 8/1935 | United Kingdom . |
| 500117 | 1/1939 | United Kingdom . |
| 583096 | 12/1946 | United Kingdom . |
| 785112 | 10/1957 | United Kingdom . |

OTHER PUBLICATIONS

Chem. Abstracts 71; 92680p.

Ullmann's Encyclopedia of Technical Chemistry, 4th Ed., vol. 16, p. 118.

Kirk-Othmer, Encyclopedia of Chemical Technology, vol. 8, p. 295.

Kozhevenno—Obuvnaya Promyshlennost, No. 7, 1969, Moscow, pp. 49–51.

*Primary Examiner*—Maria Parrish Tungol

*Attorney, Agent, or Firm*—Curtis, Morris & Safford

[57] ABSTRACT

What is disclosed is a method for liming animal skins and hides which comprises treating said skins and hides with an aqueous alkaline liming liquor comprising a protective colloid, for example a protein such as gelatin, glue, or casein, or a water-soluble alkali-stable polymethacrylate.

11 Claims, No Drawings

PROCESS FOR LIMING PELTS OF ANIMAL HIDES AND SKINS

This is a division of application Ser. No. 122,041, filed Feb. 19, 1980, now U.S. Pat. No. 4,310,328.

The present invention relates to the liming of pelts of animal skins and hides.

In the processing of skins or hides into leather, the soaked and cleaned skin, which has been freed from a portion of the soluble protein, is usually subjected to a further processing step in the beamhouse with the objective of loosening hairs and the connection between the epidermis and the true skin.

For this purpose, primarily chemicals and especially lime are used in the so-called "liming". An important role is also played by processes in which sodium sulfide, calcium sulfide, ammonium sulfide, or mixtures of these compounds are used with the hydroxides (sulfide liming). By using sulfide liming, the pelts are prevented from becoming undesirably plump.

Recently, it has become possible to improve the liming process by the addition of further agents instead of, or along with, the inorganic sulfides, such as, for example: alkali sulfites, bisulfites, hyposulfites, or especially, mercaptans and mercaptides. The use of thioglycolic acid has proven to be particularly advantageous.

A "sulfide-free" liming is obtained if lime-containing and sulfur-containing, non-sulfidic reducing agents, such as sulfites or hyposulfites are used. German Pat. No. 2,053,016 recommends a liming process in which the skins or hides are treated with an aqueous liming liquor containing lime with the addition of sulfur-containing reducing agents or with a sulfide liming liquor which additionally contains urea and hydrazine and optionally an organic amine such as dimethylamine.

Even today, the use of liming requires a considerable amount of experience, since the hide material behaves differently in the liming depending on the kind, age, and origin of the animals. It is, for example, important to control the degree of swelling and plumpness or tautness of the leather fiber structure with a view to the qualities of the leather desired. In the case of intensive liming, it is well known that the collagen fibrils of the true skin lose their characteristic transverse striation and are irreversibly split up into filaments (see, for example, F. Strather, in "Gerbereichemie und Gerbereitechnologie" 4th Edition, Akademie-Verlag, Berlin, 1967, page 189). With increasing duration and temperature of liming, an increasing portion of the collagen is converted into soluble nitrogen compounds. Moreover, care must be taken to ensure that the grain suffers no damage, for example from the action of microorganisms. The danger of "over-liming" is recalled here (F. Strather, loc. cit., page 197).

Finally, the question of how to organize the liming process so that there is a minimal pollution of the environment is constantly gaining in importance. On the other hand, steps taken to improve the liming process should not lead to an unreasonable increase in the cost of the process.

Practical experience has shown time and again that it is difficult to do justice to all the different requirements.

It has now been found that the conventional requirements as well as the rest of the specifically mentioned requirements of a modern liming process can largely be fulfilled if at least one protective colloid is added to an aqueous, alkaline lime, and if the liming liquor so obtained is allowed to act on the skins or hides.

In the context of the present invention, suitable protective colloids (=organic hydrophilic colloids) are to be understood to be water-soluble, alkali-stable, high molecular weight polymers of natural or synthetic origin. In particular, proteins with protective colloid properties are suitable (see also "Kolloid-chemisches Taschenbuch", issued by A. Kuh, First Edition, Leipzig, 1935, pages 28–33, and Fifth Edition, Leipzig, 1960, pages 43–56). As a rule, such proteins have a molecular weight between 10,000 and 250,000. Examples of such proteins are lysalbic acid or its alkali salts and protalbic acid or its salts, which obtained by the action of caustic alkalis, on proteins, especially ovalbumin and, to a lesser extent, also serum albumin, [C. Paal, Ber. 35, 2195 (1902)], peptones, as well as albumins and casein itself, and especially gelatins and glue.

Further, pertinently used carbohydrates such as dextrin, soluble starch and starch derivatives, pectins and their derivatives, mucins, gum arabic, sulfite liquor, and the like (cf. "Kolloidchemisches Taschenbuch", loc. cit.) are suitable.

In addition, water-soluble, alkali-stable, synthetic high molecular weight polymers, especially saponification products of polyvinyl acetate, polyvinyl alcohols, homopolymers and copolymers of unsaturated polymerizable acids such as maleic acid, fumaric acid, and their anhydrides, as well as acrylic and methacrylic acids and their amides and, moreover, polyvinylpyrrolidone, are suitable for use in conjunction with the present invention. As comonomers for the synthesis of the said polymers, styrene and the esters of acrylic acid and/or of methacrylic acid come into consideration. The molecular weight of the polymers is generally between $1\times10^3$ and $1\times10^7$, and preferably between $10^4$ and $10^6$.

The synthesis of the synthetic high molecular weight polymers is known [cf. Th. Völker in "Oster. chem. Zeitung" 62/11, 345 (1961)].

The ratio of protective colloid to hide or skin which is to be limed is appropriately measured such that the protective colloid action is promoted to the fullest extent possible. Probably the simplest model concept is based on the assumption that the protective colloid more or less completely covers the hide. Accordingly, the quantity of protective colloid can be stated in terms of the surface area of the hide. In general however, it is sufficient to ensure that enough of the material which acts as a protective colloid is present in the liming batch, whereby, in practice, the use of an excess above the (calculable) absolutely necessary amount of protective colloid can be recommended.

As a rule, very satisfactory results are obtained if at least 0.02 percent, preferably 0.05 to 1 percent, and more preferably 0.05 to 0.2 percent of protective colloid are used, based on the weight of the rawhide or skin.

The simultaneous use of hydrotropic agents (see F. Strather, loc. cit., page 87) together with the aforementioned protective colloids is particularly preferred. Hydrotropic agents are substances exhibiting the property of hydrotropy, that is the inherent ability of the substances to render water-soluble or water-swellable, or emulsifiable, other materials which would otherwise be insoluble or difficultly soluble in water [cf. C. Neuberg, Biochem, Zeitschr. 107 (1916)]. To a certain extent this activity coincides with the ability of the hydrotropic agents to break hydrogen bonds.

In other respects, liming of the hide can be carried out according to processes already known in the art (see also F. Strather, loc. cit., pages 67–190). The use of the process according to the invention in conjunction with the liming process described in U.S. Pat. No. 1,973,130 or German Pat. No. 2,053,016 is especially preferred. The advantageous effect of the process of the present invention is demonstrated particularly well when using a sulfide-containing lime, whether it be in the form of a pure sodium sulfide lime or of a calcium hydroxide/-sodium sulfide lime used in a modern variation of this process. Especially when proteins are used as protective colloids, the sulfide present in the liming batch does not appear to be present in the free state in proportion to its concentration, at least not insofar as its effect on the hide is concerned. As a simple model concept, one can imagine the interaction between the protective colloid and the sulfide as an adsorptive bonding. The release of sulfide from the protective colloid to the surface of the hide would therefore be rate-determining for the effect on the hide.

As a result of the presently described process, a surprisingly uniform loosening of hair, associated with an equally striking uniform swelling, is observed.

In carrying out the described liming process, the simultaneous use of a protective colloid with hydrotropic agents is particularly desirable. Examples of hydrotropic agents are urea, thiourea, formamide, acetamide, calcium chloride, thiocyanates, etc., as well as the sulfonic acids and carboxylic acids of aromatic and of aliphatic compounds, for example sodium cumene sulfonate, sodium toluene sulfonate, and the like, as well as surface-active products (surfactants) [cf., for example, H. Rath et al. in Melliands Textilber. 43 (7), 718 (1962)], especially nonionic wetting agents. The content of hydrotropic agents may advantageously be between 0.1 and 2.0 percent, and preferably between 0.2 and 1.0 percent, based on the weight of the hide. By the combination of protective colloids and hydrotropic agents, surprising results which could not have been anticipated either qualitatively or quantitatively are obtained with the process of the present invention.

For example, an unusually rapid thorough liming is observed, even for the hides of large animals. By the combination of the alkaline liming medium with the hydrotropically acting agents, a different degree of swelling is achieved than by swelling with a charge of alkalis alone. This is shown, for example, by the fact that the pelts are generally not taut but are only softly swollen, but are nevertheless transparent.

When using hydrotropic agents, an opening of the skin structure is obtained which, as shown by physical examination of the leather, corresponds to that of a post-limed pelt. Moreover, the moderate degree of swelling usually leads to a 2–3% higher area yield than can be achieved with a pure charge swelling. If the leather is dried in the taut state, area enlargements of 5–7% can be observed.

Further, the combination of protective colloids, hydrotropically active substances, and sulfur compounds in the liming process of the invention is especially suitable. Sulfur compounds that are particularly appropriate are the known organic sulfur compounds such as thioglycolic acid, mercaptoethanol, and thioacetic acid. According to present observations, the said combination with organic sulfides leads to a gelatinization of hair which is different from that achieved with inorganic sulfides. For example, smaller peptides are obtained as products, the subsequent biological degradation of which in the effluent proceeds more readily. In the gelatinization, smaller fragments of hair are obtained, but these may be separated in the effluent.

The combination according to the invention of protective colloids with hydrotropic agents leads moreover to so extensive a degradation of the scud that the latter is removed almost entirely from the pelt during the mechanical operations of fleshing and splitting. Finally, by using the described combination, it is also possible to work without using lime. Alternatively, as has already been mentioned, soluble calcium compounds (calcium chloride) may also be used.

As has already been mentioned also, the liming process of the invention can be combined extensively with already known procedures.

Initially, the hide is softened in the usual manner. In addition, preservative salt is removed by a washing process of approximately 2 hours' duration with agitation. The softening can be carried out in the form of a pure water softening of 12 to 15 hours' duration, or by using proteolytic enzymes in the form of a short softening of 4 to 6 hours' duration. The liming process of the invention is carried out at the conclusion of the softening.

In order to save water, the liming these days is usually carried out in the softening liquor. Conventional vessels such as vats, mixers, or washing machines can be used for carrying out the liming. Equipment such as this requires less liquor than winch gear.

The chemicals required for loosening the hair and digesting the hide are suitably added all at once. This method of handling leads to a rapid and complete loosening of hair and scud.

In the case of pure lime/sodium sulfide liming, 24 to 36 hours are required for opening up the hide structure sufficiently for the production of a soft chrome leather. However, for liming process of the invention, 10 to 15 hours are sufficient. Post-liming generally is not required. For better handling when carrying out the mechanical work of fleshing and splitting, the hides and skins are washed once or twice after liming.

A better understanding of the present invention and of its many advantages will be had by referring to the following Examples, given by way of illustration.

Example 1

Low-sulfide Process 100 kg of cowhides are first washed and subsequently softened in a vat. Liming takes place in the softening liquor with:

100% of water, 26° C.;
0.1% of gelatin;
0.15% of mercaptoethanol;
0.14% of urea;
0.5% of caustic soda;
0.2% of thioglycolic acid;
0.5% of sodium hydrogen sulfide, 95%;
1.0% of sodium sulfide, concentrated; and
3.0% hydrated lime.

(All percentages are based on the salt weight of the hides.) The components are added at the beginning. Before being added to the bath, the caustic soda is to be dissolved 1:5 in water, but the temperature of the solution must not exceed 30° C. when added to the bath. At the beginning of the liming process the liquor and hides are revolved for 2 hours at 4 rpm.

Liming requires 5–16 hours. During the night, the vat is agitated once again for 5 minutes.

Before it is emptied, the vat is agitated once more for 10 minutes.

In order to avoid excessive slipperiness of the pelts during the mechanical work of fleshing and splitting, it is necessary to wash the pelts twice with 100% of water at 25° C.

The pelts obtained are completely free of hair and scud and exhibit only moderate swelling.

A collagen hydrolysate having about 10–50 peptide groups, preferably 30–50 peptide groups, can be used with similarly good results, as can casein, and hide glue, bone glue, or other partial hydrolyzates of skin (cf. German Offenlegungschrift No. 2,705,671).

Example 2

Sulfide-free Manufacturing Method as Liming Process 100 kg of red bullhides are first washed in a mixer in order to remove preservative salt. Subsequently, they are subjected to a brief, enzymatic softening for 4 hours.

For carrying out loosening of the hair and opening the hide structure, half the liquor is discharged.

Liming is begun with:

40% of water at 26° C.;
0.25% of a water-soluble alkali-stable sodium polymethacrylate (commercially available as "Rohagit SL 147");
0.5% of mercaptoethanol;
1.0% of thiourea;
0.5% of thioglycolic acid;
1.0% of caustic soda; and
3.0% of hydrated lime, all based on the salt weight of the hides. (The caustic soda is dissolved as in Example 1.)

Agitation is continued (120 minutes) until the hairs can be pushed away.

Now, 50% of water at 26° C. is added and the batch is agitated for 20 minutes more.

Liming time: 5–15 hours.

Before removing the pelts, they are washed twice, for 20 minutes each time, with 90% of water at 26° C.

The pelts are free of hair and scud, and have no grain contraction and only shallow fat-wrinkles. They are not taut.

Example 3

"Hide Processor"

100 kg of dried goat skins are first softened well, preferably enzymatically. The softening liquor is discharged except for about 40%. Hair is loosened and the hide digested with:

40% of softening liquor at 26° C.;
0.2% of glutin;
0.1% of mercaptoethanol;
0.2% of sodium cumene sulfonate;
0.2% of thioacetic acid;
0.9% of sodium sulfide, concentrated; and
2.5% of caustic soda (99% flakes), which is dissolved in 10 parts of water before the addition.

(The percentages in the liming refer to the weight of the (softened skins.)

The skins and liquor are first agitated for 120 minutes. After this time, the hairs must be completely loosened so that they can be pushed away.

Now 40% of water at 26° C. is added and the batch is agitated for 30 minutes more.

Liming time: 20–22 hours.

During the night, the batch is briefly agitated several times. The same before discharging.

Before fleshing, the hides are rinsed twice with 80% of water at 25° C. for 20 minutes.

At the end of the liming process, the pelts are completely free of hair and base, exhibit only moderate swelling, and have no grain contraction.

Example 4

Low-sulfide Vat Liming for Sheep Skins

For liming 100 kg of softened sheep skins in a vat, the following solution is initially used (the percentages refer to the softened weight of the skins):

40% of water, 28° C.;
0.2% of egg albumin;
0.1% of glucose;
0.2% of mercaptoethanol;
0.2% of thioglycolic acid;
0.2% of urea;
1.0% of calcium chloride;
2.0% of caustic soda;
0.5% of sodium hydrogen sulfide, 95%; and
0.5% of sodium sulfide, concentrated.

The skins and liquor are revolved for 90 minutes at 3–5 rpm. After this time, the wool should be loosened completely and be able to be pushed away by hand.

Then the vat is filled up with 100% of water at 25° C. and revolved every hour for 25 minutes.

After a liming period of 5 hours, the liming liquor is discharged. The pelts are washed twice with 100% of water in the usual manner, as described in Examples 1–3.

The pelts are completely clean, softly swelled and show no grain contraction. The striations prevalent in sheep pelts are pulled out smooth.

Example 5

Sulfide-free Liming for Calf Skins in a Vat 100 kg of calf skins are first washed to remove the preservative salt. This is followed by a 4-hour enzymatic softening. Liming follows in the softening liquor in the vat. (The percentages relate to the salt weight of the skins.)

Lime:

100% of softening liquor at 28° C.;
0.2% of dextrin;
0.5% of mercaptoethanol;
1.0% of thiourea;
0.5% of thioglycolic acid;
0.2% of nonionic wetting agent;
1.0% of caustic soda (99%); and
3.0% of hydrated lime.

Revolve for 2 hours at 4 rpm.

At the end of the agitation, loosening of the hairs must have progressed sufficiently so that the hairs can be pushed away. Subsequently, the batch is agitated only at intervals. Before discharging the liquor, the batch is agitated once again for 10 minutes. Washing follows as in the aforementioned examples.

Liming time: 12–15 hours.

The pelts are completely free of hair and scud, softly swelled, and have no grain contraction.

What is claimed is:

1. A method for liming animal skins and hides which comprises treating said skins and hides in a bath of an aqueous alkaline liming liquor comprising from 0.02 to 1 percent, by weight of the skins and hides, of a protective colloid which is a water soluble, alkali stable, high molecular weight polymer of natural or synthetic origin, together with a hydrotropic agent.

2. A method as in claim 1 wherein said liming liquor additionally comprises sulfur compounds conventionally employed for liming and selected from the group consisting of sodium sulfide, calcium sulfide, ammonium sulfide, mixtures of these sulfides, alkali sulfites, bisulfites, hyposulfites, mercaptans, mercaptides, and thioglycolic acid.

3. A method as in claim 1 wherein said liming liquor additionally comprises thioglycolic acid.

4. A method as in claim 1 wherein said liming liquor additionally comprises mercaptoethanol.

5. A method as in claim 1 wherein said liming liquor additionally comprises thioacetic acid.

6. A method as in claim 1 wherein said protective colloid is a protein.

7. A method as in claim 6 wherein said protein has a molecular weight between 10,000 and 250,000.

8. A method as in claim 1 wherein said protective colloid is a member selected from the group consisting of casein, bone glue, gelatin, skin glue, and other partial hydrolyzates of skin.

9. A method as in claim 8 wherein said protective colloid is a partial hydrolyzate of skin.

10. A method as in claim 1 wherein said protective colloid is present in said liming liquor in an amount of at least 0.02 percent by weight of said skins and hides.

11. A method as in claim 1 wherein said hydrotropic agent is present in said liming liquor in an amount from 0.1 to 2 percent by weight of said skins and hides.

* * * * *